US006532749B2

(12) United States Patent
Rudick et al.

(10) Patent No.: US 6,532,749 B2
(45) Date of Patent: Mar. 18, 2003

(54) STIRLING-BASED HEATING AND COOLING DEVICE

(75) Inventors: Arthur G. Rudick, Atlanta, GA (US); Jean-Marc Rotsaert, Atlanta, GA (US); James M. Graber, Columbus, OH (US); Joseph M. Lehman, New Albany, OH (US); Dwight S. Musgrave, Granville, OH (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/917,230

(22) Filed: Jul. 27, 2001

(65) Prior Publication Data

US 2002/0005043 A1 Jan. 17, 2002

Related U.S. Application Data

(63) Continuation-in-part of application No. 09/401,164, filed on Sep. 22, 1999, now Pat. No. 6,272,867, and a continuation-in-part of application No. 09/813,637, filed on Mar. 21, 2001.

(51) Int. Cl.[7] ..... F25B 9/00; F25D 21/06; B60H 1/32

(52) U.S. Cl. ..... 62/6; 62/457.9; 62/275; 62/239

(58) Field of Search ..... 62/6, 457.9, 239, 62/275, 324.2

(56) References Cited

U.S. PATENT DOCUMENTS

| | | | | |
|---|---|---|---|---|
| 1,815,170 A | | 7/1931 | Summers | |
| 2,095,008 A | | 10/1937 | Philipp | 62/115 |
| 2,342,299 A | | 2/1944 | Peet | 225/40 |
| 2,470,547 A | | 5/1949 | Childers | 62/103 |
| 2,512,545 A | | 6/1950 | Hazard | 62/125 |
| 2,660,037 A | | 11/1953 | Cooper | 62/116 |
| 2,672,029 A | | 3/1954 | Saunders | 62/117.2 |
| 2,885,142 A | | 5/1959 | Eberhart | 230/117 |
| 2,943,452 A | * | 7/1960 | Buchanan | 62/3.3 |
| 2,961,082 A | | 11/1960 | Hanson et al. | 194/13 |
| 2,970,450 A | * | 2/1961 | Roeder et al. | 62/3.3 |
| 3,004,408 A | | 10/1961 | Dros et al. | 62/419 |
| 3,206,943 A | | 9/1965 | Rice et al. | |
| 3,230,733 A | | 1/1966 | Rutishauser et al. | 62/256 |
| 3,302,429 A | | 2/1967 | Byrd | 62/514 |
| 3,315,474 A | * | 4/1967 | Farer | 62/3.61 |
| 3,712,078 A | | 1/1973 | Maynard et al. | 62/448 |
| 3,853,437 A | | 12/1974 | Horn et al. | 418/61 |
| 3,997,028 A | | 12/1976 | Lopez | 186/1 |
| 4,037,081 A | | 7/1977 | Aldridge et al. | 219/387 |
| 4,037,650 A | | 7/1977 | Randall | 165/29 |

(List continued on next page.)

FOREIGN PATENT DOCUMENTS

| | | |
|---|---|---|
| DE | CH 233 266 | 7/1944 |
| DE | 233-266 | 7/1944 |
| EP | 0 065 995 | 12/1982 |

(List continued on next page.)

OTHER PUBLICATIONS

Lyn Bowman, A Technical Introduction to Free–Piston Stirling Cycle Machines: Engines, Coolers, and Heat Pumps, May, 1993, pp. 1–7.

(List continued on next page.)

*Primary Examiner*—William C. Doerrler
(74) *Attorney, Agent, or Firm*—Sutherland, Ashbill & Brennan LLP

(57) ABSTRACT

A device for heating a first article and cooling a second article. The device may include an enclosure with a hot compartment and a cold compartment. The device also may include a Stirling cooler with a hot end and a cold end. The hot end may be positioned in communication with the hot compartment so as to heat the first article and the cold end may be positioned in communication with the cold compartment so as to cool the second article.

45 Claims, 6 Drawing Sheets

U.S. PATENT DOCUMENTS 4,138,855 A 2/1979 Jahan et al. ..... 62/112
4,176,526 A 12/1979 Missimer ..... 62/278
4,176,529 A 12/1979 Stierlin et al. ..... 62/490
4,178,772 A * 12/1979 Swenson et al. ..... 62/238.2
4,259,844 A 4/1981 Sarcia et al. ..... 62/6
4,275,705 A 6/1981 Schaus et al. ..... 126/110 R
4,306,613 A 12/1981 Christopher ..... 165/32
4,377,074 A 3/1983 Jardine ..... 62/183
4,383,421 A 5/1983 Quesnoit ..... 62/333
4,416,122 A 11/1983 Johnson ..... 62/448
4,471,633 A 9/1984 Tinsler ..... 62/295
4,480,445 A 11/1984 Goldstein ..... 62/434
4,490,991 A 1/1985 Griffin ..... 62/279
4,539,737 A 9/1985 Kerpers et al. ..... 29/423
4,554,797 A 11/1985 Goldstein ..... 62/434
4,558,570 A 12/1985 Shtrikman et al. ..... 62/6
4,694,650 A 9/1987 Vincent ..... 60/520
4,726,193 A 2/1988 Burke et al. ..... 62/3
4,753,072 A * 6/1988 Johansson et al. ..... 60/517
4,759,190 A 7/1988 Trachtenberg et al. ..... 62/3
4,783,968 A 11/1988 Highman et al. ..... 62/6
4,811,563 A 3/1989 Furuishi et al. ..... 60/517
4,823,554 A * 4/1989 Trachtenberg et al. ..... 62/3.3
4,827,733 A 5/1989 Dinh ..... 62/305
4,827,735 A 5/1989 Foley ..... 62/430
4,831,831 A 5/1989 Carter et al. ..... 62/59
4,843,826 A 7/1989 Malaker ..... 62/6
4,852,362 A 8/1989 Corny ..... 62/175
4,882,911 A 11/1989 Immel ..... 62/288
4,893,478 A 1/1990 Kruck et al. ..... 62/126
4,907,419 A 3/1990 Kruck et al. ..... 62/263
4,917,256 A 4/1990 Kruck et al. ..... 220/4 F
4,922,722 A 5/1990 Kazumoto et al. ..... 62/6
4,941,527 A 7/1990 Toth et al. ..... 165/47
4,949,554 A 8/1990 Branz et al. ..... 62/248
4,964,279 A 10/1990 Osborne ..... 62/59
4,969,333 A * 11/1990 Osawa et al. ..... 62/6
4,977,754 A 12/1990 Upton et al. ..... 62/248
4,996,841 A 3/1991 Meijer et al. ..... 60/525
5,007,246 A 4/1991 Kruck et al. ..... 62/131
5,009,081 A 4/1991 Kruck et al. ..... 62/264
5,069,273 A 12/1991 O'Hearne ..... 165/12
5,076,351 A 12/1991 Munekawa et al. .... 165/104.21
5,094,083 A 3/1992 Horn et al. ..... 62/6
5,142,872 A 9/1992 Tipton ..... 62/6
5,172,567 A 12/1992 Sadhir ..... 62/434
5,228,299 A 7/1993 Harrington et al. ..... 62/55.5
5,259,198 A 11/1993 Viegas et al. ..... 62/7
5,259,214 A 11/1993 Nagatomo et al. ..... 62/324.1
5,284,022 A 2/1994 Chung ..... 62/6
5,303,769 A 4/1994 Hoegberg ..... 165/108
5,305,825 A 4/1994 Roehrich et al. ..... 165/64
5,309,986 A 5/1994 Itoh ..... 165/104.26
5,311,927 A 5/1994 Taylor et al. ..... 165/64
5,333,460 A 8/1994 Lewis et al. ..... 62/6
5,341,653 A 8/1994 Tippmann et al. ..... 62/288
5,347,827 A 9/1994 Rudick et al. ..... 62/440
5,363,671 A 11/1994 Forsythe et al. ..... 62/197
5,402,654 A 4/1995 Rudick et al. ..... 62/448
5,406,805 A 4/1995 Radermacher et al. ..... 62/81
5,417,079 A 5/1995 Rudick et al. ..... 62/253
5,417,081 A 5/1995 Rudick et al. ..... 62/440
5,438,848 A 8/1995 Kim et al. ..... 62/342
5,440,894 A 8/1995 Schaeffer et al. ..... 62/203
5,493,874 A 2/1996 Landgrebe ..... 62/457.2
5,496,153 A 3/1996 Redlich ..... 417/212
5,524,453 A 6/1996 James ..... 62/434
5,525,845 A 6/1996 Beale et al. ..... 310/30
5,537,820 A 7/1996 Beale et al. ..... 62/517
5,542,257 A 8/1996 Mattern-Klosson et al. . 62/55.5
5,551,250 A 9/1996 Yingst et al. ..... 62/234
5,596,875 A 1/1997 Berry et al. ..... 62/6
5,638,684 A 6/1997 Siegel et al. ..... 62/6
5,642,622 A 7/1997 Berchowitz et al. ..... 62/6
5,645,407 A 7/1997 Kralick et al. ..... 417/383
5,647,217 A 7/1997 Penswick et al. ..... 62/6
5,647,225 A 7/1997 Fischer et al. ..... 62/434
5,649,431 A 7/1997 Schroeder, Jr. ..... 62/434
5,655,376 A 8/1997 Price ..... 62/6
5,664,421 A * 9/1997 Matsue et al. ..... 62/6
5,678,409 A 10/1997 Price ..... 62/6
5,678,421 A 10/1997 Maynard et al. ..... 62/407
5,724,833 A 3/1998 Devers ..... 62/625
5,735,131 A 4/1998 Lambright, Jr. et al. ..... 62/99
5,743,098 A 4/1998 Behr ..... 62/80
5,743,102 A 4/1998 Thomas et al. ..... 62/185
5,782,106 A 7/1998 Park ..... 62/452
5,794,444 A 8/1998 Hofbauer et al. ..... 60/517
5,878,581 A 3/1999 DeFrances et al. ..... 62/50.2
5,881,566 A 3/1999 Shacklock et al. ..... 62/277
5,895,033 A 4/1999 Ross et al. ..... 267/161
5,906,290 A 5/1999 Haberkorn ..... 220/505
5,920,133 A 7/1999 Penswick et al. ..... 310/17
5,927,079 A 7/1999 Sekiya et al. ..... 62/6
5,927,080 A 7/1999 Lee ..... 62/6
6,003,319 A 12/1999 Gilley et al. ..... 62/3.7
6,023,937 A 2/2000 Rodrigues ..... 62/295
6,067,804 A 5/2000 Moeykens et al. ..... 62/84
6,073,547 A 6/2000 Westbrooks, Jr. et al. .... 99/468
6,079,481 A 6/2000 Lowenstein et al. ..... 165/10
6,112,526 A 9/2000 Chase ..... 62/6
6,148,634 A 11/2000 Sherwood ..... 62/434
6,158,499 A 12/2000 Rhodes ..... 165/10
6,161,389 A * 12/2000 Sekiya et al. ..... 62/6
6,178,770 B1 1/2001 Bradley, Jr. et al. ..... 62/434
6,266,963 B1 * 7/2001 Rudick ..... 62/6
6,282,906 B1 * 9/2001 Cauchy ..... 62/3.3

FOREIGN PATENT DOCUMENTS

EP 0 697 089 8/1999
EP 0 936 421 8/1999
FR 2-609-789 7/1988
JP 64-36468 2/1989
JP 01 269874 10/1989
JP 2-217758 8/1990
JP 7-180921 7/1995
JP WO 98/34076 8/1998
JP 0 935 063 A2 8/1999
JP 304745 A * 10/2001 ..... 62/6
WO WO 86/00977 2/1986
WO WO 89/06774 7/1989
WO WO 94/25811 11/1994
WO WO 95/02795 1/1995
WO WO 96/29555 9/1996
WO WO 97/39296 10/1997
WO WO 99/23425 5/1999
WO WO 99/58914 11/1999

OTHER PUBLICATIONS

B.D. Mennink et al., "Development of an Improved Stirling Cooler for Vacuum Super Insulated Fridges With Thermal Store and Photovoltaic Power Source for Industrialized and Developing Countries," May 10–13, 1994 pp. 1–9.

D.M. Berchowitz et al., "Recent Advances in Stirling Cycle Refrigeration," Aug. 20–25, 1995, 8 pages.

Kelly McDonald et al., "Stirling Refrigerator for Space Shuttle Experiments," Aug. 7/11, 1994; 6 pages.

Sunpower, Inc., "Introduction to Sunpower, Stirling Machines and Free–Piston Technology," Dec., 1995.

D.M. Berchowitz et al., "Test Results for Stirling Cycle Cooled Domestic Refrigerators," Sep. 3–6, 1996, 9 pages.
Royal Vendors, Inc., "G–III All Purpose Vendor Operation and Service Manual," Sep., 1996, pp. 1–67.
D.M. Berchowitz et al., "Stirling Coolers for Solor Refrigerators," 10 pages.
Michael K. Ewert et al., "Experimental Evaluation of a Solar PV Refrigerator with Thermoelectric, Stirling and Vapor Compression Heat Pumps," 7 pages.
D.M. Berchowitz, Ph.D., "Maximized Performance of Stirling Cycle Refrigerators," 8 pages.
David Bergeron, "Heat Pump Technology Recommendation for a Terrestrial Battery–Free Solar Refrigerator," Sep., 1998, pp. 1–25.
Seon–Young Kim, et al., "The Application of Stirling Cooler to Refrigeration," pp. 1023–1026.
R.H. Green, et al., "The Design and Testing of a Stirling Cycle Domestic Freezer," pp. 153–161.
Abstract of Japanese Publication No. 02302563 (Toshiba Corp.) Dec. 14, 1990.
Abstract of Japanese Publication No. 03036468 (Toshiba Corp.) Feb. 18, 1991.
Abstract of Japanese Publication No. 03294753 (Toshiba Corp.) Dec. 25, 1991.
Abstract of Japanese Publication No. 04217758 (Toshiba Corp.) Aug. 7, 1992.
Abstract of Japanese Publication No. 05203273 (Toshiba Corp.) Aug. 10, 1993.
Abstract of Japanese Publication No. 05306846 (Toshiba Corp.) Nov. 19, 1993.
Abstract of Japanese Publication No. 07180921 (Toshiba Corp.) Jul. 18, 1995.
Abstract of Japanese Publication No. 08005179 (Toshiba Corp.) Jan. 12, 1996.
Abstract of Japanese Publication No. 08100958 (Toshiba Corp.) Apr. 16, 1996.
Abstract of Japanese Publication No. 08247563 (Toshiba Corp.) Sep. 27, 1996.

* cited by examiner

STIRLING-BASED HEATING AND COOLING DEVICE

RELATED APPLICATIONS

The present application is a continuation-in-part of application Ser. No. 09/401,164, filed Sep. 22, 1999, now U.S. Pat. No. 6,272,867, and a continuation-in-part of application Ser. No. 09/813,637, filed Mar. 21, 2001.

FIELD OF THE INVENTION

The present invention relates generally to refrigeration and heating systems and more specifically relates to an apparatus driven by a Stirling cooler and having a heated area and/or a cooled area.

BACKGROUND OF THE INVENTION

Known refrigeration systems generally have used conventional vapor compression Rankine cycle devices to chill a given space. In a typical Rankine cycle apparatus, the refrigerant in the vapor phase is compressed in a compressor so as to cause an increase in temperature. The hot, high-pressure refrigerant is circulated through a heat exchanger, called a condenser, where it is cooled by heat transfer to the surrounding environment. As a result, the refrigerant condenses from a gas back to a liquid. After leaving the condenser, the refrigerant passes through a throttling device where the pressure and the temperature are reduced. The cold refrigerant leaves the throttling device and enters a second heat exchanger, called an evaporator, located in or near the refrigerated space. Heat transfer with the evaporator and the refrigerated space causes the refrigerant to evaporate or to change from a saturated mixture of liquid and vapor into a superheated vapor. The vapor leaving the evaporator is then drawn back into the compressor so as to repeat the refrigeration cycle.

Attempts to use such a Rankine cycle system to refrigerate a portable device, however, have been largely unsuccessful. The typical components of a Rankine cycle system are generally too large, too heavy, and too loud. Further, such systems generally contain noxious or greenhouse gases. As a result, most Rankine cycle systems are used for stationary refrigeration devices.

Similarly, attempts have been made to use the waste heat generated in a Rankine cycle system to provide heat to a warming compartment spaced apart from the refrigeration area. Although waste heat is generated, the relatively large and cumbersome configuration required by a Rankine cycle system, may make it difficult to transfer effectively the waste heat to the warming compartment. Separating the refrigeration components and the warming compartment generally may lessen the efficiency of the system as a whole.

One alternative to the use of a Rankine cycle system is a Stirling cycle cooler. The Stirling cycle cooler is also a well-known heat transfer mechanism. Briefly described, a Stirling cycle cooler compresses and expands a gas (typically helium) to produce cooling. This gas shuttles back and forth through a regenerator bed to develop much greater temperature differentials than may be produced through the normal Rankine compression and expansion process. Specifically, a Stirling cooler may use a displacer to force the gas back and forth through the regenerator bed and a piston to compress and expand the gas. The regenerator bed may be a porous element with significant thermal inertia. During operation, the regenerator bed develops a temperature gradient. One end of the device thus becomes hot and the other end becomes cold. See David Bergeron, *Heat Pump Technology Recommendation for a Terrestrial Battery-Free Solar Refrigerator,* September 1998. Patents relating to Stirling coolers include U.S. Pat. Nos. 5,678,409; 5,647,217; 5,638,684; 5,596,875 and 4,922,722, all incorporated herein by reference.

Stirling cooler units are desirable because they are nonpolluting, efficient, and have very few moving parts. The use of Stirling coolers units has been proposed for conventional refrigerators. See U.S. Pat. No. 5,438,848, incorporated herein by reference. The integration of a free-piston Stirling cooler into a conventional refrigerated cabinet, however, requires different manufacturing, installation, and operational techniques than those used for conventional compressor systems. See D. M. Berchowitz et al., *Test Results for Stirling Cycle Cooler Domestic Refrigerators,* Second International Conference. As a result, the use of the Stirling coolers in refrigerators or similar devices is not well known.

Likewise, the use of Stirling coolers in portable refrigeration devices is not well known to date. Further, the use of Stirling coolers to heat and to cool simultaneously separate compartments of a device is not known. A need exists therefore for adapting Stirling cooler technology to portable refrigeration and heating devices.

SUMMARY OF THE INVENTION

The present invention thus provides for a device for heating a first article and cooling a second article. The device may include an enclosure with a hot compartment and a cold compartment. The device also may include a Stirling cooler with a hot end and a cold end. The hot end may be positioned in communication with the hot compartment so as to heat the first article and the cold end may be positioned in communication with the cold compartment so as to cool the second article.

Specific embodiments of the present invention include the use of an insulated divider positioned between the hot compartment and the cold compartment. The Stirling cooler may include a regenerator positioned between the hot end and the cold end. The regenerator may be positioned within the insulated divider. The enclosure may include a handle for carrying the enclosure.

The cold end of the Stirling cooler may include a cold end heat exchanger. The cold compartment may include a Stirling cooler section with a fan, a product section with a product support for positioning the second article thereon, and an airflow path for circulating air through the Stirling cooler section and the product section. The product support may include a number of apertures therein in communication with the airflow path.

The cold compartment may include a sensor for determining the temperature therein. The sensor may be in communication with a controller. The enclosure may include an external vent positioned adjacent to the cold compartment. The controller may be in communication with the external vent so as to open the vent when the temperature within the cold compartment drops below a predetermined temperature.

The cold compartment also may include a divider positioned between the Stirling cooler section and the product section. The divider may include an internal vent therein. The internal vent may include a first internal vent positioned on a first side of the divider and a second internal vent positioned on a second side of the divider. The enclosure may include a number of external vents positioned adjacent to the cold compartment. The controller may be in communication with the internal vent and the external vents so as to close the internal vent and so as to open the external vents when the temperature within the cold compartment drops below a predetermined temperature and the ambient temperature is below freezing.

The hot end of the Stirling cooler may include a hot end heat exchanger. The hot compartment may include a Stirling cooler section with a fan, a product section with a product support for positioning the first article thereon, and an airflow path for circulating air through the Stirling cooler section and the product section. The hot compartment may include a sensor for determining the temperature therein. The enclosure may include an external vent positioned adjacent to the hot compartment. The sensor may be in communication with the external vent so as to open the vent when the temperature within the hot compartment rises above a predetermined temperature.

The device may further include a wick extending from about the cold end of the Stirling cooler in the cold compartment to about the hot end of the Stirling cooler in the hot compartment. The cold compartment may include a condensate collector positioned adjacent to the cold end of the Stirling cooler and the wick so as to collect condensate and wick it to the hot compartment.

A further embodiment of the present invention may provide for a Stirling cooler driven device for use with ambient temperatures above and below freezing. The device may include an enclosure. The enclosure may include a Stirling cooler section for positioning the Stirling cooler therein, a product section, and a divider positioned therebetween. The divider may include an internal vent. The enclosure may include a number of external vents positioned adjacent to the Stirling cooler section.

The device also may include an internal temperature sensor positioned within the enclosure and an external temperature sensor positioned on the enclosure. The sensors may be in communication with a controller. The controller may open at least a first one of the external vents when the temperature within the enclosure drops below a predetermined temperature and the ambient temperature is above freezing. The controller may close the internal vent and open the external vents when the temperature within the enclosure drops below the predetermined temperature and the ambient temperature is below freezing. The predetermined temperature may be below about thirty-two degrees Fahrenheit (zero degrees Celsius).

A further embodiment of the present invention may provide for a device for heating a first article with a hot end of a Stirling cooler and cooling a second article with a cold end of the Stirling cooler. The device may include a hot compartment with the hot end of the Stirling cooler positioned therein and a cold compartment with the cold end of the Stirling cooler positioned therein. A hot compartment vent may be positioned adjacent to the hot compartment and a cold compartment vent may be positioned adjacent to the cold compartment. A hot compartment sensor may be positioned within the hot compartment. The hot compartment sensor may be in communication with the hot compartment vent so as to open the vent when the temperature within the hot compartment rises above a first predetermined temperature. A cold compartment sensor may be positioned within the cold compartment. The cold compartment sensor may be in communication with the cold compartment vent so as to open the vent when the temperature within the cold compartments falls below a second predetermined temperature.

A further embodiment of the present invention provides for a temperature-controlled device for use with an electrical receptacle of a vehicle. The device may include a portable enclosure. The portable enclosure may have an interior space to be heated or cooled, a Stirling cooler positioned about the enclosure for providing heating or cooling to the interior space, and an electrical line for powering the Stirling cooler via the electrical receptacle.

A further embodiment of the present invention may provide for a heating and cooling device. The device may include an enclosure with a Stirling cooler, a hot compartment, and a cold compartment. The Stirling cooler may have a hot end heat exchanger positioned in communication with the hot compartment and a cold end heat exchanger positioned in communication with the cold compartment. The hot compartment may include a fan positioned adjacent to the hot end heat exchanger. The cold compartment may include a condensate collector positioned adjacent to the cold end heat exchanger so as to collect condensate from the cold end heat exchanger. The device also may include a wick. The wick may extend from the condensate collector in the cold compartment to the hot compartment so as to wick condensate from the condensate collector to the hot compartment and so as to evaporate the condensate via an air stream produced by the fan.

A further embodiment of the present invention may provide for a transportable apparatus. The apparatus may include an insulated enclosure for containing a number of containers. The enclosure may be mountable in a vehicle. A dispensing path therein may be defined by a pair of spaced members. The apparatus also may include a Stirling cooler. The Stirling cooler may be powerable by the vehicle's electrical system. The enclosure may have an inside, an outside, and an outlet for dispensing the containers. The dispensing path may include a first member positioned adjacent to the outlet such that the containers in the dispensing path contact the first member before being dispensed through the outlet. The Stirling cooler may include a hot portion and a cold portion. The cold portion of the Stirling cooler may be in heat transfer relationship with the first member. A second member may be connected in heat transfer relationship to the first member and to the cold portion of the Stirling cooler.

A method of the present invention may include powering a Stirling cooler by a vehicle's electrical system and contacting at least a portion of a container to be dispensed from an insulated enclosure with a heat-conducting member before the container is dispensed from the enclosure. Heat then may be transferred from the container to the heat-conducting member to a cold portion of the Stirling cooler.

A further method of the present invention may include contacting at least a portion of a container to be dispensed from an insulated enclosure disposed in a vehicle with a heat-conducting member before the container is dispensed from the enclosure. Heat may then be transferred from the container to the heat-conducting member to a cold portion of a Stirling cooler. The Stirling cooler being powered by an electrical system of the vehicle.

A further embodiment of the present invention may provide for a transportable apparatus for containing a number of containers. The apparatus may include an insulated enclosure. The enclosure may be positioned within a vehicle having an electrical system. A Stirling cooler may be positioned in communication with the enclosure. The Stirling cooler may be in communication with the electrical system. The insulated enclosure may include a dispensing path with one or more doors. The Stirling cooler may include a cold end and a hot end. A plate may be in communication with the cold end and at least part of the dispensing path. The cold end or the hot end may be in communication with the enclosure.

Other objects, features, and advantages of the present invention will become apparent upon review of the following specification, when taken in conjunction with the drawings and the appended claims.

BRIEF DESCRIPTION OF THE DRAWINGS

FIG. 6 is a side cross-sectional view of the heating/cooling device taken along line 4—4 of FIG. 3 with the heating compartment vent open.

DETAILED DESCRIPTION OF THE INVENTION

Figure 1:
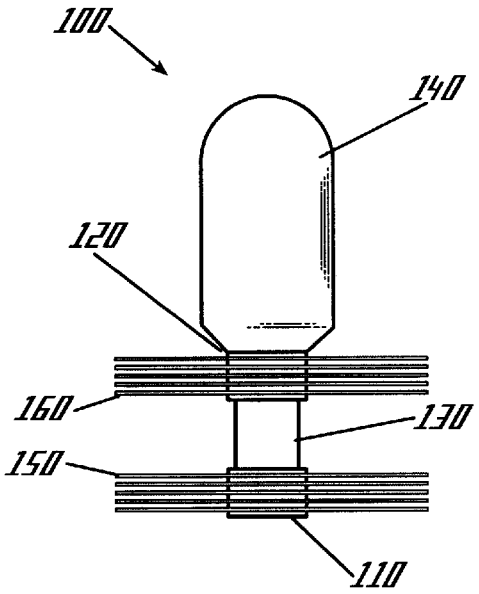
FIG. 1 is a top plan view of a Stirling cooler unit.
Figure 2:
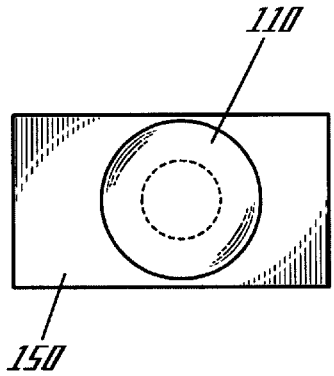
FIG. 2 is an end plan view of the Stirling cooler unit of FIG. 1.
Figure 3:
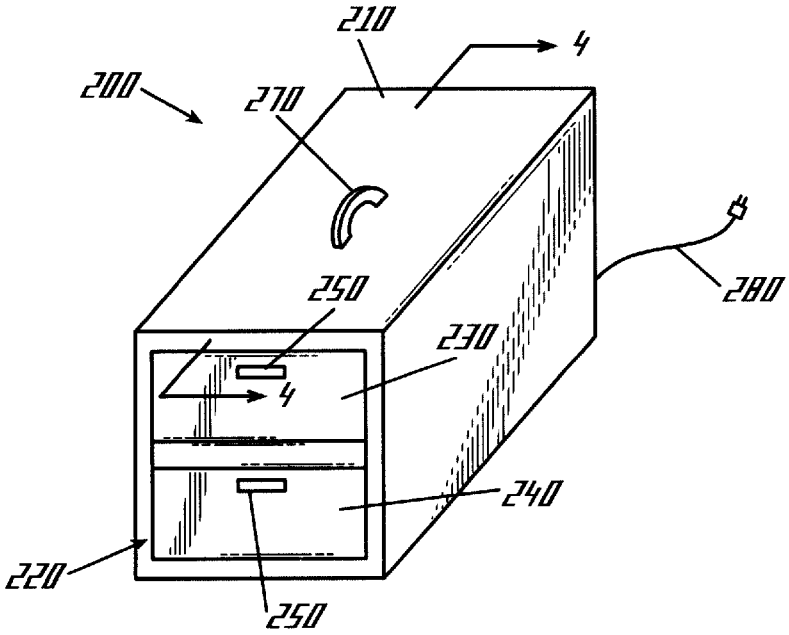
FIG. 3 is a perspective view of the heating/cooling device of the present invention.
Figure 4:
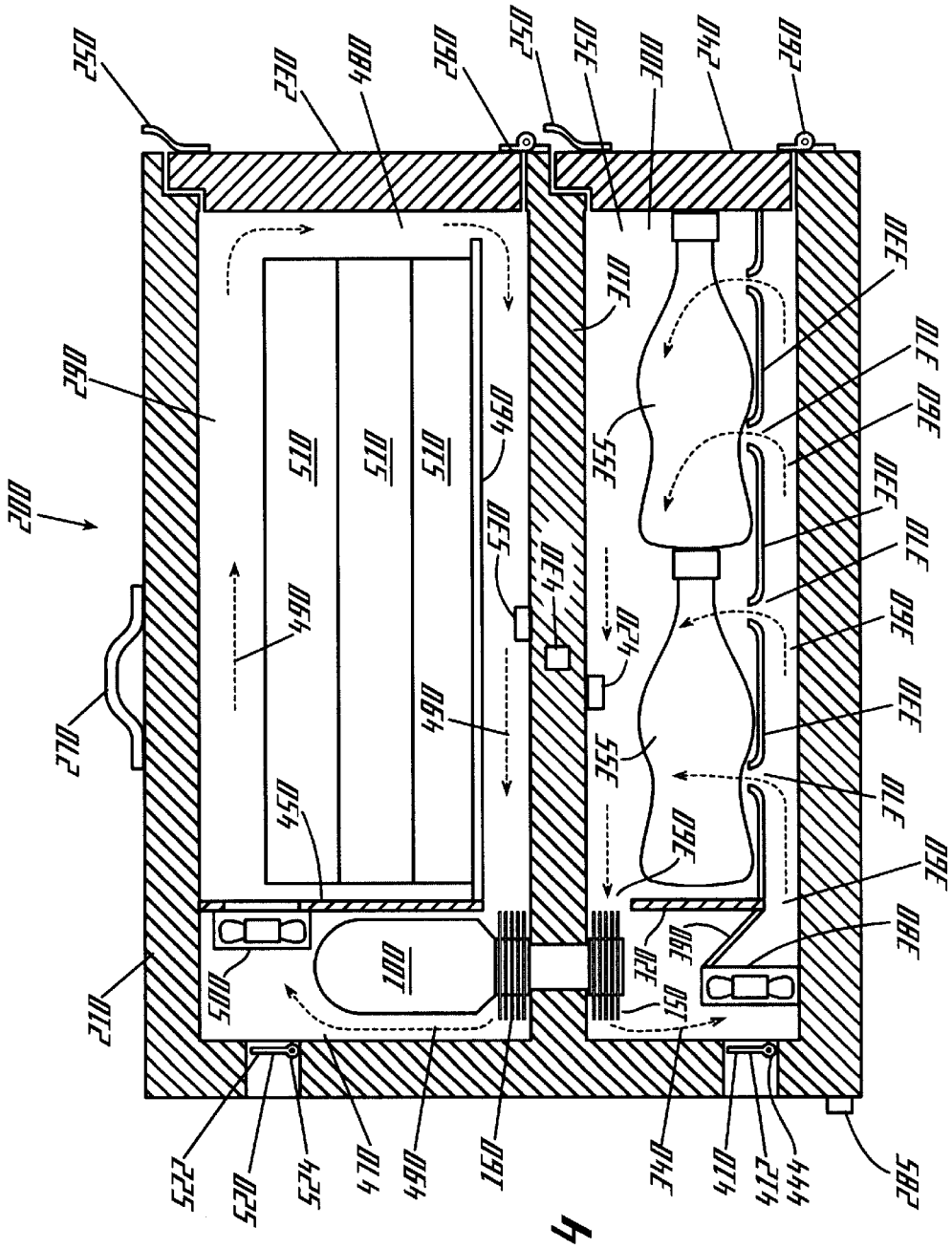
FIG. 4 is a side cross-sectional view of the heating/cooling device taken along line 4—4 of FIG. 3.
Figure 5:
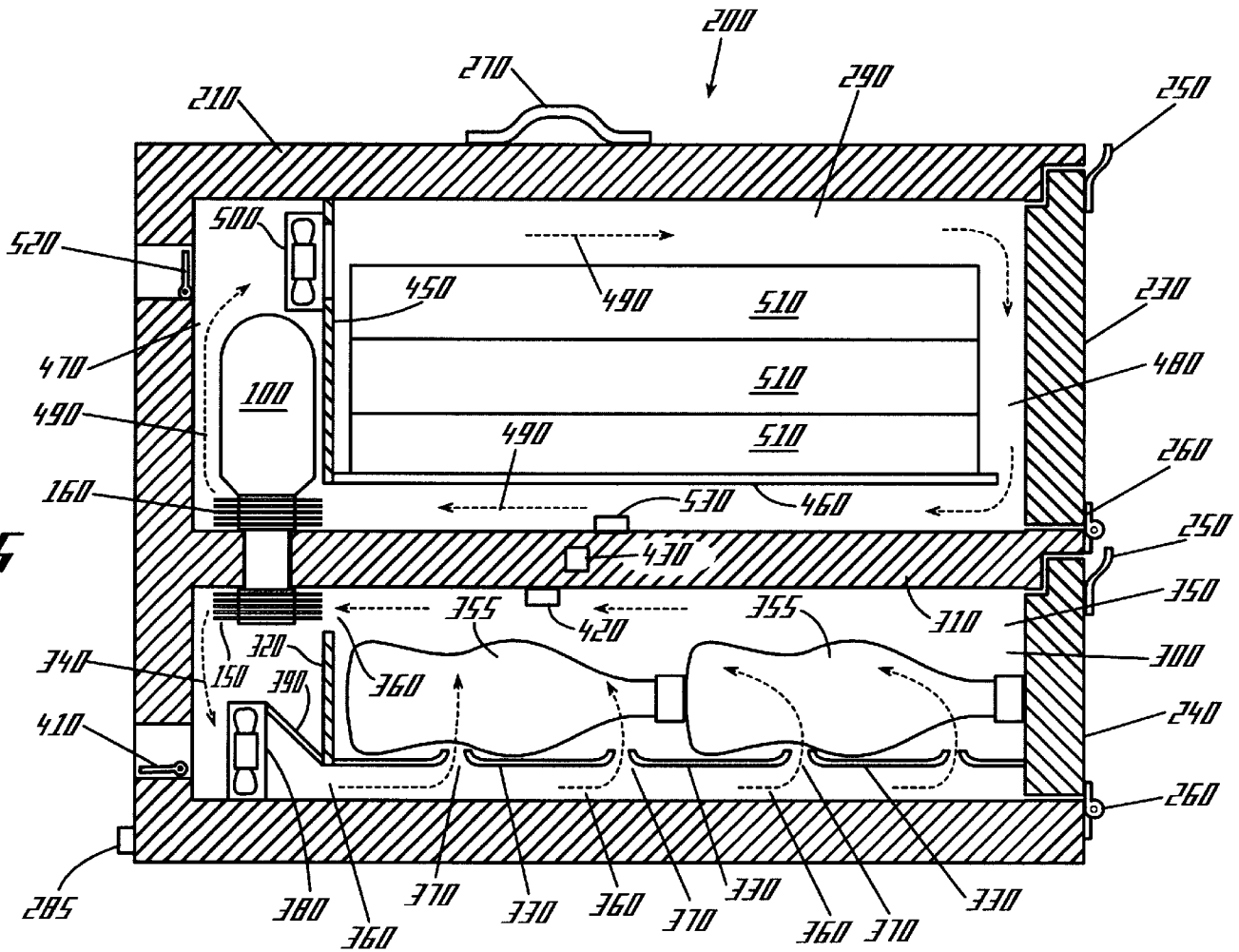
FIG. 5 is a side cross-sectional view of the heating/cooling device taken along line 4—4 of FIG. 3 with the cooling compartment vent open.
Figure 5:
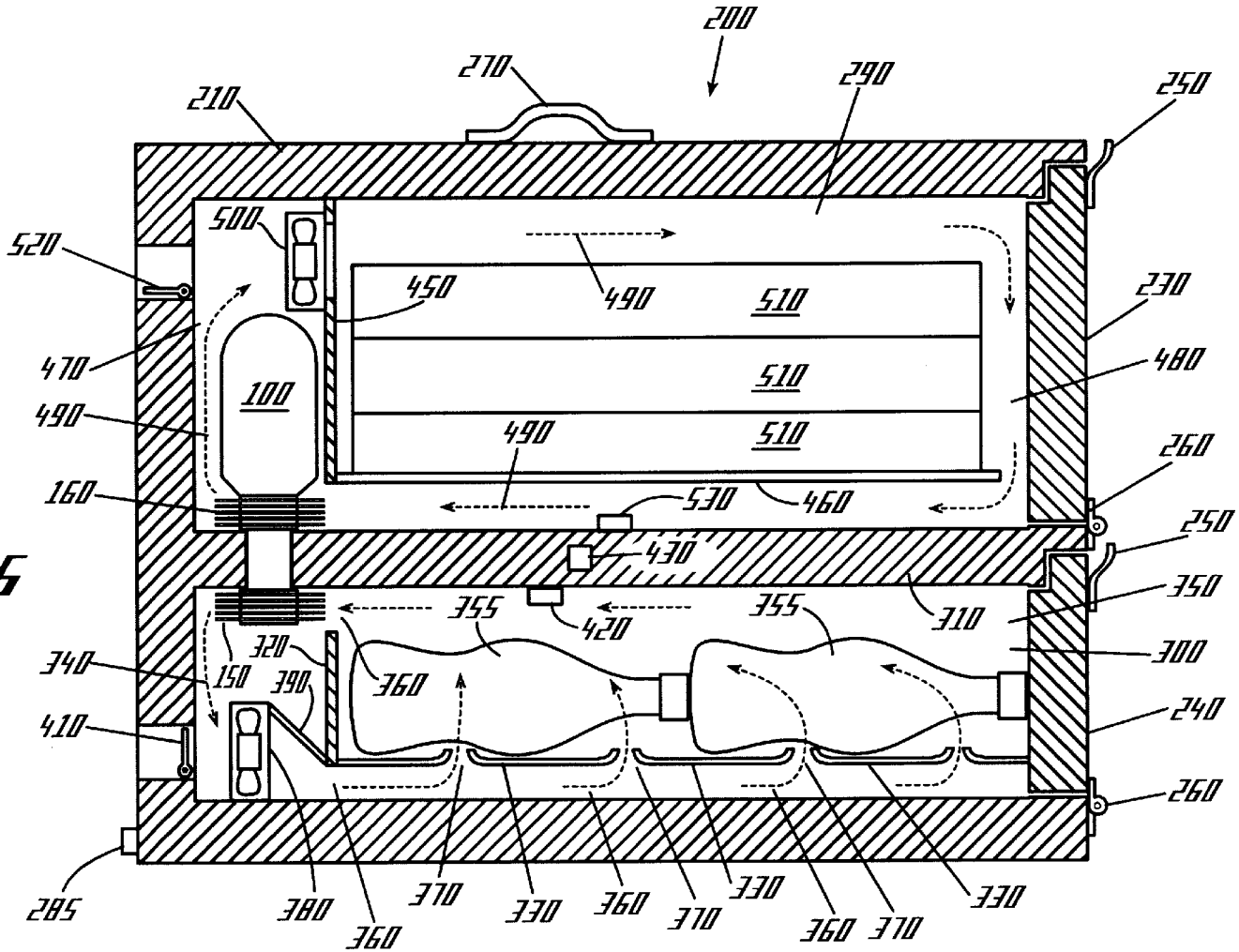

Referring now to the drawings in which like numerals indicate like elements throughout the several views, FIGS. 1 and 2 show a Stirling cooler 100 for use with the present invention. As is well known, the Stirling cooler 100 may include a cold end 110 and a hot end 120. A regenerator 130 may separate the cold end 110 and the hot end 120. The Stirling cooler 100 may be driven by a free piston (not shown) positioned within a casing 140. The Global Cooling Company of Athens, Ohio may manufacture a Stirling cooler 100 suitable for use with the present invention. Any conventional type of free piston Stirling cooler 100, however, may be used herein. Any numbers of the Stirling coolers 100 also may be used. The size and the number of the Stirling coolers 100 used herein may depend upon the size and the capacity of the refrigeration system as a whole.

A cold end heat exchanger 150 may be located on the cold end 110 of the Stirling cooler 100. The cold end heat exchanger 150 may be a cross-flow finned heat exchanger or any conventional type of heat exchange device. The heat exchanger 150 may be made out of copper, aluminum, or similar types of materials. A hot end heat exchanger 160 may be positioned on the hot end 120 of the Stirling cooler 100. The hot end heat exchanger 160 also may be a cross-flow finned heat exchanger or a similar type of device. The heat exchanger 160 also may be made out of copper, aluminum, or similar types of materials. The size of the heat exchangers 150, 160 may depend upon the size of the Stirling cooler 100 as a whole.

FIGS. 3–6 show a heating/cooling container 200 of the present invention. The heating/cooling container 200 may include an insulated outer shell 210. The insulated outer shell 210 may be made out of expanded polystyrene foam, polyurethane foam, or similar types of insulated materials. The insulated outer shell 210 may include a number of doors 220. For example, a hot compartment door 230 and a cold compartment door 240 are shown. The doors 220 may each have a handle 250 and may be attached to the insulated outer shell 210 by a conventional hinge 260 or a similar device. The insulated outer shell 210 also may have a handle 270 for carrying the heater/cooler container 200. The container 200 also may have a power cord 280 to power the Stirling cooler or coolers 100 therein. The power cord 280 may plug into a conventional electric outlet or into an electrical receptacle such as, for example, an automobile lighter compartment. Alternatively, a conventional battery pack also may be used.

A temperature sensor 285 may be positioned on the outer shell 210 so as to determine the ambient temperature. The sensor 285 may be a conventional temperature sensor such as a thermocouple, a thermistor, or similar types of devices. The sensor 285 also may be in communication with a controller as described in more detail below.

The container 200 may have a hot compartment 290 and a cold compartment 300. The hot compartment door 230 may be positioned adjacent to the hot compartment 290 while the cold compartment door 240 may be positioned adjacent to the cold compartment 300. An insulated divider 310 may separated the hot compartment 290 and the cold compartment 300. The insulated divider 310 may be out of expanded polystyrene foam, polyurethane foam, or similar types of materials with good insulating characteristics.

The Stirling cooler 100 may be positioned within the container 200 such that the hot end 120 and the hot end heat exchanger 160 are within or adjacent to the hot compartment 290 while the cold end 110 and the cold end heat exchanger 150 are within or adjacent to the cold compartment 300. The regenerator 130 may be positioned, in whole or in part, within the insulated divider 310.

The cold compartment 300 may have a non-insulated divider 320 and a support plate 330 positioned therein. The non-insulated divider 320 may define a Stirling cooler section 340 and a product section 350. The Stirling cooler section 340 may house the cold end 110 of the Stirling cooler 100 while the product section 350 may house a number of products 355. The products 355 may include any item intended to be chilled, such as a beverage container. Likewise, the support plate 330 also defines the product section 350 and an airflow path 360. The support plate 330 may have a number of apertures 370 therein that lead from the airflow path 360 to the product section 350. The airflow path 360 may extend through the Stirling cooler section 340 and the product section 350.

Positioned within the Stirling cooler section 340 may be a fan 380. Although the term "fan" 380 is used herein, the fan may be any type of air movement device, such as a pump, a bellows, a screw, and the like known to those skilled in the art. The Stirling cooler section 340 also may include a shroud 390 positioned therein. The shroud 390 may direct the flow of air through the fan 380 and into the airflow path 360.

A vent 410 may be formed in the outer insulated shell 210 adjacent to the Stirling cooler section 340 of the cold compartment 300. The vent 410 may be an open or shut door type device with a door 412 and a movable hinge 414. The vent 410 may be in communication with a sensor 420. The sensor 420 may be a conventional temperature sensor such as a thermocouple, a thermistor, or similar types of devices. The vent 410 and the sensor 420 also may be in communication with a controller 430 so as to open or shut the vent 410 depending upon the temperature as sensed by the sensor 420 in relationship to the ambient temperature as sensed by the external sensor 285. The controller 430 may be a conventional microprocessor. The programming of the controller 430 may be in any conventional programming language. The controller 430 may be programmed so as to open the vent 410 if the temperature within the cold compartment 300 drops below a given set point temperature.

The hot compartment 290 also may include a non-insulated divider 450 and a support plate 460. The non-insulated divider 450 may define a Stirling cooler section 470 and a product section 480 similar to that described above. The support plate 460 may define an airflow path 490 communicating between the Stirling cooler section 470 and the product section 480. The Stirling cooler section 470 may include a fan 500. As described above, although the term "fan" 500 is used herein, the fan 500 may be any type of air movement device, such as a pump, a bellows, a screw, and the like known to those skilled in the art. The fan 500 may circulate air through the hot end heat exchanger 160, into the product section 480, and back through the air flow path 490. A number of hot products 510 may be positioned on the support plate 460. The hot products 510 may include any item intended to be heated, such as a number of pizza boxes or other types of hot food containers.

The hot compartment 290 also may include a hot compartment vent 520. As described above with respect to vent 410, the vent 520 may be an open or shut type device with a door 522 and a movable hinge 524. The vent 520 may be in communication with a sensor 530 and the controller 430. The sensor 530 may be similar to the sensor 420 described above. The controller 430 may open the vent 520 when the temperature as sensed by the sensor 530 rises above a given set point.

In use, the cold products 355 that are either cold or intended to be chilled are positioned on the support plate 330 within the cold compartment 300. Once the cold products 355 are positioned therein, the fan 380 directs a flow of air through the cold end heat exchanger 150 into the airflow path 360. The chilled air then flows through the apertures 370 of the support plate 330 and across the cold products 355. The air then returns through the cold end heat exchanger 150. This flow of air thus keeps the cold products 355 chilled.

If the sensors 420 determine that the temperature within the cold compartment 300 drops below a given temperature, for example about 34 degrees Fahrenheit (1.1 degrees Celsius), the controller 430 may open the vent 410 to allow ambient air to circulate through the cold compartment 300 if the ambient air temperature as sensed by the external sensor 285 is above freezing. The vent 410 may remain open until the temperature therein again rises above the set point as determined by the sensor 420. Alternatively, the vent 410 may be opened proportionally to let in a varying amount of ambient air. This system as a whole is designed for use where the ambient temperature is above freezing.

Likewise, the hot products 510 or the products that are to be warmed may be inserted onto the support plate 460 within the hot compartment 290. The fan 500 may circulate air through the hot end heat exchanger 160, into the product section 480, around the products 510, through the air flow path 490, and back through the fan 500. This flow of air thus keeps the hot products 510 warm.

If the sensor 530 determines that the temperature within the hot compartment 290 is above a given set point, for example about 150 degrees Fahrenheit (65.6 degrees Celsius), the controller 430 may open the vent 520 so as to allow ambient air to circulate through the hot compartment 290. The vent 520 may remain open until the temperature therein again falls below the set point as determined by the sensor 530. Alternatively, the vent 520 may be opened proportionally to let in a varying amount of ambient air.

The container 200 as a whole may be designed such that the heat leak between the hot compartment 290 and the cold compartment 300, the heat leak from within the insulated inner shell 210 and the ambient air, and the refrigeration lift of the Stirling cooler 100 are about in balance. For example, the following variables may be used:

$Q_H$=Heat flow through the wall 210 and the door 230 from the hot compartment 290 to ambient;

$Q_C$=Heat flow through the wall 210 and the door 240 from ambient to the cold compartment 300;

$Q_D$=Heat flow through the divider 310 from the hot compartment 290 to the cold compartment 300;

$Q_S$=Heat pumped by the Stirling cooler 100 from the cold compartment 300 to the hot compartment 290;

$Q_W$=Waste heat generated by the Stirling cooler 100 and dumped into the hot compartment 290;

$Q_{FH}$=Waste heat generated by the fan 500 and dumped into the hot compartment 290; and $Q_{FC}$=Waste heat generated by the fan 380 and dumped into the cold compartment 300.

Given a cold compartment 300 temperature ($T_C$) of about 34 degrees Fahrenheit (1.1 degrees Celsius), a hot compartment temperature ($T_H$) of about 150 degrees Fahrenheit (65.6 degrees Celsius), and an ambient temperature ($T_A$) of about 75 degrees Fahrenheit (24 degrees Celsius), the insulation of the container 200 and the power level of the Stirling cooler 100 may be selected such that the following relationship is in place:

$$Q_S=Q_C+Q_D+Q_{FC}=Q_H+Q_D-Q_W-Q_{FH}$$

Specifically, the Stirling cooler 100 may have a capacity of about 40 Watts with a hot compartment 290 having an area of about 2,000 cubic inches (about 32,744 $cm^3$) and a cold compartment 300 having an area of about 1,000 cubic inches (about 16,387 $cm^3$). Given these variables, the system as a whole can be used in stabilized conditions with the hot compartment 290 and the cold compartment 300 at their respective set points with little or no need for opening the vents 410, 520. As the ambient temperature ($T_A$) moves away from the design temperature ($T_A$=75 degrees Fahrenheit (24 degrees Celsius)), the need for opening the vents 410, 520 increases.

Figure 7:
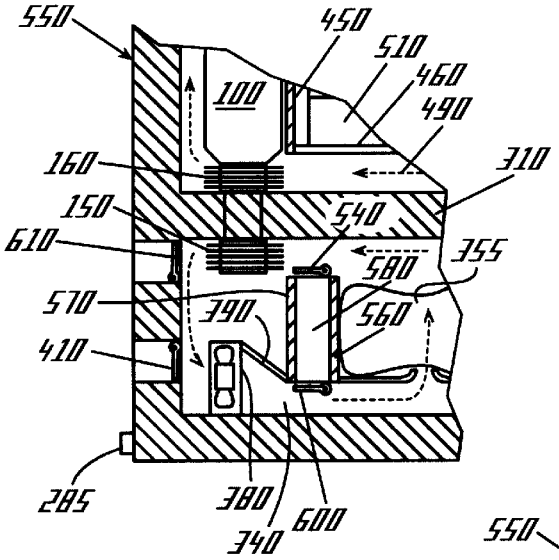
FIG. 7 is a partial side cross-sectional view of an alternative embodiment of the heating/cooling device with the external vents closed and the internal vents open.
Figure 8:
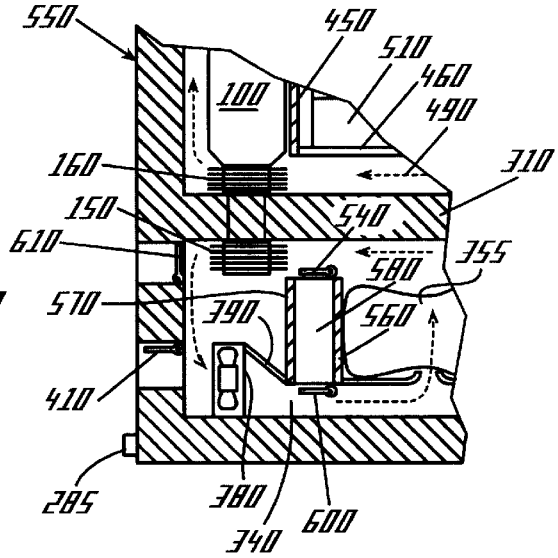
FIG. 8 is a partial side cross-sectional view of the alternative embodiment of the heating/cooling device of FIG. 7 with one of the external vents open.
Figure 9:
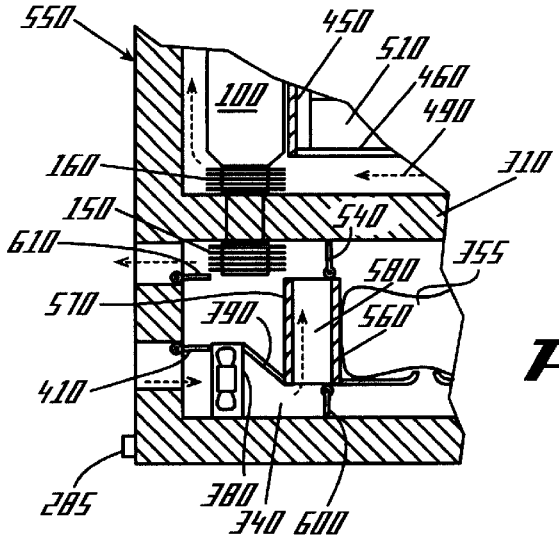
FIG. 9 is a partial side cross-sectional view of the alternative embodiment of the heating/cooling device of FIG. 7 showing the external vents open and the internal vents closed.

FIGS. 7–9 show an alternative embodiment of the present invention. The container 200 of FIGS. 3–6 may not be effective when the ambient air temperature is below freezing. A container 550, however, may be adapted to deal with such an environment. The container 550 may be identical to the container 200 with the exception that the non-insulated divider 320 is replaced with a first divider 560 and a second divider 570. The dividers 560, 570 may be made out of plastic, metal, or similar materials. The dividers 560, 570 may form an air pathway 580 therebetween.

Positioned on one of the dividers 560, 570 may be a first internal vent 590. Positioned on the other end of the dividers 560, 570 may be a second internal vent 600. When closed, the internal vents 590, 600 may separate the Stirling cooler section 340 from the product section 300. The Stirling cooler section 340 also may have an additional exterior vent 610 positioned within the insulated outer shell 210. The vents 410, 590, 600, 610 may all operate under the control of the controller 430 based upon the temperature as sensed by the sensor 420 and the external sensor 285.

FIG. 7 shows the normal operating environment for the container 550. In this environment, the exterior vents 410, 610 are closed while the internal vents 590, 600 are opened. The cold compartment 300 thus operates as described above with respect to FIG. 4. Likewise, FIG. 8 shows the configuration of the container 500 when the ambient temperature is above freezing but the internal temperature is below the set point. In this case, one or both of the external vents 410, 610 may be open so as to allow ambient air to circulate within the cold compartment 300 as shown in FIG. 6.

FIG. 9 shows the configuration of the container 500 when the ambient temperature is below freezing and the temperature within the cold compartment 300 is below the set point. In this situation, the external vents 410, 610 may be open while the internal vents 590, 600 are closed. Closing the internal vents 590, 600 effectively isolates the product section 350 from the Stirling cooler section 340. Air is thus drawn into the Stirling cooler section 340 by the fan 380 and is directed through the air pathway 580 and through the cold end heat exchanger 150. The cold air is then circulated back out through the second exterior vent 610. In this case, the Stirling cooler 100 acts largely as a heat pump without adding any additional refrigeration to the cold compartment 300.

Figure 10:
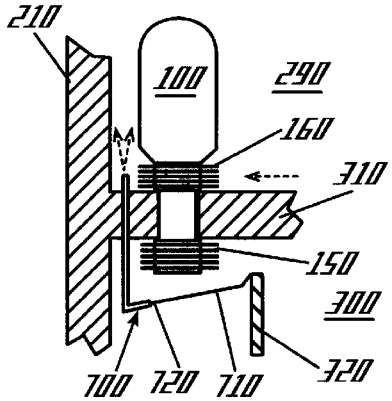
FIG. 10 is a partial side cross-sectional view of an alternative embodiment of the present invention showing a condensate collection system.

FIG. 10 shows an alternative embodiment of the present invention having a condensate collection system 700. The condensate collection system 700 may use the heating/cooling container 200 as described in detail herein with the Stirling cooler 100. The condensate collection system 700 also may include a condensate collector 710 attached to the non-insulated divider 320. The condensate collector 710 may be made out of metal, plastic, or similar types of somewhat rigid materials. The condensate collector 710 may extend from the non-insulated divider 320 along the length of cold end heat exchanger 150.

The condensate collection system 700 also may have a wick 720 positioned adjacent to the condensate collector 710. The wick 720 may be made out of hydra chamois, polyester fabrics, synthetic sponge (polyvinyl alcohol), or similar materials with wicking characteristics. The wick 720 may extend from the condensate collector 710, through the insulated divider 310, and into the hot compartment 290 adjacent to the hot end heat exchanger 160. The condensate collector 710 may be angled somewhat downward such that the condensate will flow towards the wick 720. The wick 720 may be mounted directly to the condensate collector 710 or to the inner wall of the outer shell 210 so as not to interfere with the cold air stream. The wick 720 may cover part of the condensate collector 710 so as to assist in absorption of the condensate.

Any condensate developed in the cold compartment 300 may form about the cold end heat exchanger 150. The condensate then may drip on to the condensate collector 710. The condensate may flow down the condensate collector 710 towards the wick 720. The condensate may then be absorbed by the wick 720. The wick 720 may then carry the condensate through the insulated divider 310 and into the hot compartment 290 adjacent to the hot end heat exchanger 160. The wick 720 may move the condensate by capillary action. As such, the condensate is wicked to the hot compartment 290 regardless of the orientation of the heating/cooling container 200 as a whole, i.e., normal gravity does not play a significant role in the wicking action. Once the condensate within the wick 720 reaches the hot compartment 290, the condensate may be evaporated via the hot air stream flowing through the hot end heat exchanger 160.

Figure 11:
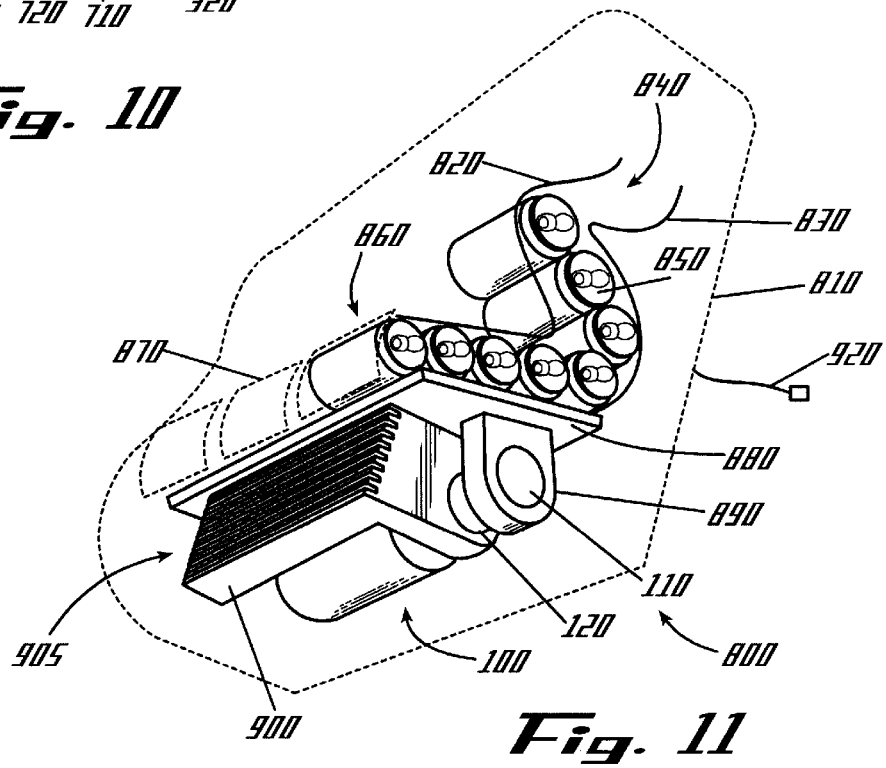
FIG. 11 is a perspective view of an alternative embodiment of the present invention showing a portable chilling device with the casing shown in phantom lines.
Figure 12:
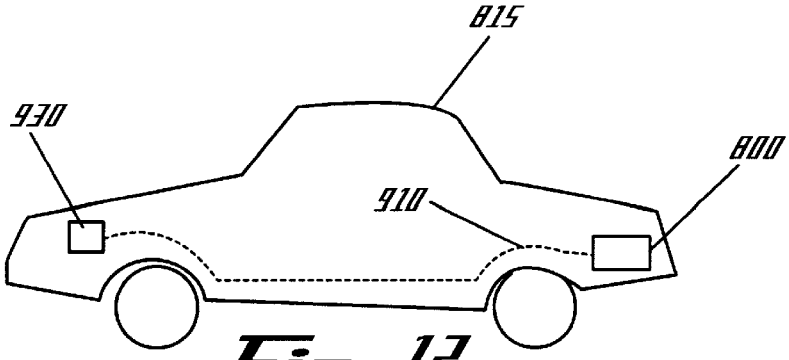
FIG. 12 is a schematic view of a vehicle with the portable chilling device of FIG. 11 shown therein.

A further embodiment of the present invention is shown in FIGS. 11 and 12. These figures show a transportable container dispenser 800. The dispenser 800 may include an exterior case 810 (shown in phantom lines in FIG. 11). The shape of the case 810 is not critical to the present invention. Rather, the case 810 may be of any size and shape necessary to accommodate the internal mechanism and also may be pleasing to the eye. Furthermore, the case 810 may be sized and shaped so as to be transportable in a vehicle 815 such as a car, a taxi cab, a bus, a train, a boat, an airplane, or the like.

Inside the case 810 may be a pair of spaced plates 820, 830. The plates 820, 830 may define a dispensing path 840. A plurality of containers 850 may be stacked in the dispensing path 840. The plates 820, 830 may be arranged in a serpentine manner so that at least a portion of the dispensing path 840 is serpentine in shape. Although the present invention is illustrated as having a serpentine dispensing path 840, the particular shape of the dispensing path 840 is not critical to the present invention. For example, the dispensing path 840 may be vertically straight or it may be slanted. One of the purposes of the dispensing path 840 is to provide storage for as many of the containers 850 as can be accommodated by the space provided within the case 810. The walls of the case 810 also may include insulation (not shown) so that heat transfer from the surroundings outside the case 810 to the inside of the case 810 is minimized.

The dispensing path 840 may include a dispensing end 860 located adjacent to the bottom of the dispensing path 840. One or more doors 870 may be provided in the case 810 adjacent to the end 860 of the dispensing path 840 so that the containers 850 at the end of the dispensing path 840 may be manually retrieved from inside the case 810.

At least a portion of the dispensing path 840 adjacent to the end 860 thereof is defined by a plate 880. The plate 880 may be made from a heat-conducting material, such as aluminum. At least a portion of each of the containers 850 may contact the plate 880 while in the portion of the dispensing path 840 adjacent to the end 860 thereof. Thus, at least a portion of each of the containers 850 is in contact heat exchange relationship with the plate 880 immediately prior to being dispensed through the door 870.

A member 890 may connect the plate 880 in heat exchange relationship with the cold portion 110 of the Stirling cooler 100. The member 890 may be made from a heat-conducting material, such as aluminum. Therefore, heat from the plate 880 may flow through the member 890 to the cold portion 110 of the Stirling cooler 100. By operation of the Stirling cooler 100, heat from the cold portion 110 is transferred to the hot portion 120. The hot portion 120 of the Stirling cooler 100 may be connected to a radiator 900. The radiator 900 may be made from a heat-conducting material, such as aluminum. The radiator 900 also may include a plurality of fins 905 so as to increase the surface area of the radiator 900 that is exposed to the surrounding air. Vents (not shown) may be provided in the case 810 to permit air outside the case to circulate through the area adjacent the radiator 900. A fan (not shown) also may be included adjacent to the radiator 900 to facilitate the movement of air across the radiator 900 to thereby increase the amount of heat transferred from the radiator 900 to the surrounding air. A layer of insulation (not shown) also may be provided between the radiator 900 and the hot portion 120 of the Stirling cooler 100 and the cold portion 110 of the Stirling cooler 100, the member 890, and the plate 880.

The Stirling cooler 100 may be connected by an electrical circuit to a controller that is also connected by an electrical circuit to a sensor within the insulated enclosure defined by the case 810 and the layer of insulation (not shown). The controller may regulate the operation of the Stirling cooler 100 so that a desired temperature is maintained within the insulated enclosure. The controller and the sensor may be similar to those described above.

The transportable container dispenser 800 may be operated by placing a plurality of the containers 850 in the dispensing path 840. The Stirling cooler 100 may be connected directly to an electrical system 910 of the vehicle 815 in which the dispenser 800 is to be transported. The Stirling cooler 100 also may be connected to the electrical system 910 by an electrical circuit 920 plugging into, for example, the lighter outlet or other type of electrical outlet within the vehicle 815. In addition to operating from the vehicle's electrical system 910 when the vehicle's motor is running, the Stirling cooler 100 may have a sufficiently low current demand so as to operate from the vehicle's battery 930 overnight without depleting the vehicle's battery 930 of sufficient power to start the vehicle 815.

With the containers 850 stacked in the dispensing path 840, those containers 850 adjacent to the end 860 of the dispensing path 840 are in metal-to-metal contact with the plate 880. This contact permits heat in the containers 850, and the contents thereof, to be transferred to the plate 880. Heat from the air surrounding the plate 880 is also transferred to the plate 880. The heat from the plate 880 is then transferred to the cold portion 110 of the Stirling cooler 100 through the member 890. The Stirling cooler 100 transfers the heat from the cold portion 110 to the hot portion 120, and, then, to the radiator 900. Heat from the radiator 900 is transferred to the surrounding air. The result is that the containers 850 are cooled to a desired temperature.

It should be apparent that the foregoing relates only to the preferred embodiments of the present invention and that numerous changes and modifications may be made herein without departing from the spirit and scope of the invention as defined by the following claims.

We claim:

1. A device for heating a first article and cooling a second article, said device comprising:

an enclosure;

said enclosure comprising a hot compartment and a cold compartment;

a Stirling cooler;

said Stirling cooler comprising a hot end and a cold end and wherein said hot end is positioned in communication with said hot compartment so as to heat said first article and wherein said cold end is positioned in communication with said cold compartment so as to cool said second article; and an external vent such that said external vent opens when the temperature within said cold compartment or said hot compartment falls out of a pre-determined range.

2. The device of claim 1, wherein said enclosure comprises an insulated divider positioned between said hot compartment and said cold compartment.

3. The device of claim 2, wherein said Stirling cooler comprises a regenerator positioned between said hot end and said cold end and wherein said regenerator is positioned within said insulated divider.

4. The device of claim 1, wherein said enclosure comprises a handle for carrying said enclosure.

5. The device of claim 1, wherein said cold end of said Stirling cooler comprises a cold end heat exchanger in communication therewith.

6. The device of claim 1, wherein said cold compartment comprises a Stirling cooler section with a fan.

7. The device of claim 6, wherein said cold compartment comprises a product section with a product support for positioning said second article thereon.

8. The device of claim 7, wherein said cold compartment comprises an airflow path for circulating air through said Stirling cooler section and said product section.

9. The device of claim 8, wherein said product support comprises a plurality of apertures therein in communication with said airflow path.

10. The device of claim 1, wherein said cold compartment comprises a sensor for determining the temperature therein, said sensor in communication with a controller.

11. The device of claim 10, wherein said enclosure comprises said external vent positioned adjacent to said cold compartment and wherein said controller is in communication with said external vent so as to open said external vent when the temperature within said cold compartment drops below a predetermined temperature.

12. The device of claim 10, wherein said enclosure comprises an external sensor for determining the external temperature, said external sensor in communication with said controller.

13. The device of claim 12, wherein said cold compartment comprises a Stirling cooler section, a product section, and a divider positioned therebetween.

14. The device of claim 13, wherein said divider comprises an internal vent therein, said internal vent comprising an open position to allow communication between said Stirling cooler section and said product section and a closed position blocking communication between said Stirling cooler section and said product section.

15. The device of claim 14, wherein said internal vent comprises a first internal vent positioned on a first side of said divider and a second internal vent positioned on a second side of said divider.

16. The device of claim 14, wherein the enclosure comprises a plurality of external vents and wherein said controller is in communication with said internal vent and said plurality of external vents so as to close said internal vent and so as to open said plurality of external vents when the temperature within said cold compartment drops below a predetermined temperature and the ambient temperature is below freezing.

17. The device of claim 1, wherein said hot end of said Stirling cooler comprises a hot end heat exchanger in communication therewith.

18. The device of claim 1, wherein said hot compartment comprises a Stirling cooler section with a fan.

19. The device of claim 18, wherein said hot compartment comprises a product section with a product support for positioning said first article thereon.

20. The device of claim 19, wherein said hot compartment comprises an airflow path for circulating air through said Stirling cooler section and said product section.

21. The device of claim 1, wherein said hot compartment comprises a sensor for determining the temperature therein.

22. The device of claim 21, wherein said enclosure comprises said external vent positioned adjacent to said hot compartment and wherein said sensor is in communication with said external vent so as to open said external vent when the temperature within said hot compartment rises above a predetermined temperature.

23. The device of claim 1, further comprising a wick extending from about said cold end of said Stirling cooler in said cold compartment to about said hot end of said Stirling cooler in said hot compartment.

24. The device of claim 23, wherein said cold compartment comprises a condensate collector positioned adjacent to said cold end of said Stirling cooler and said wick.

25. A Stirling cooler driven device for use with ambient temperatures above and below freezing, comprising:

an enclosure;

said enclosure comprising a Stirling cooler section for positioning said Stirling cooler therein, a product section, and a divider positioned therebetween;

said divider comprising an internal vent therein; and said enclosure comprising a plurality of external vents positioned adjacent to said Stirling cooler section.

26. The Stirling cooler driven device of claim 25, further comprising an internal temperature sensor positioned within said enclosure in communication with a controller and an external temperature sensor positioned on said enclosure in communication with said controller, said controller in communication with said interior vent and said plurality of external vents.

27. The Stirling cooler driven device of claim 26, wherein said controller opens at least a first one of said plurality of external vents when the temperature within said enclosure drops below a predetermined temperature and the ambient temperature is above freezing.

28. The Stirling cooler driven device of claim 26, wherein said controller closes said internal vent and opens said plurality of external vents when the temperature within said enclosure drops below a predetermined temperature and the ambient temperature is below freezing.

29. The Stirling cooler driven device of claim 28, wherein said predetermined temperature is below about thirty-two degrees Fahrenheit (zero degrees Celsius).

30. The Stirling cooler driven device of claim 25, wherein said internal vent comprising an open position to allow communication between said Stirling cooler section and said product section and a closed position blocking communication between said Stirling cooler section and said product section.

31. The Stirling cooler device of claim 30, wherein said internal vent comprises a first internal vent positioned on a first side of said divider and a second internal vent positioned on a second side of said divider.

32. A device for heating a first article with a hot end of a Stirling cooler and cooling a second article with a cold end of the Stirling cooler, said device comprising:

a hot compartment with said hot end of said Stirling cooler positioned therein;

a cold compartment with said cold end of said Stirling cooler positioned therein;

a hot compartment vent positioned adjacent to said hot compartment;

a cold compartment vent positioned adjacent to said cold compartment;

a hot compartment sensor positioned within said hot compartment, said hot compartment sensor in communication with said hot compartment vent so as to open said hot compartment vent when the temperature within said hot compartment rises above a first predetermined temperature; and a cold compartment sensor positioned within said cold compartment, said cold compartment sensor in communication with said cold compartment vent so as to open said cold compartment vent when the temperature within said cold compartments falls below a second predetermined temperature.

33. A temperature-controlled device for use with an electrical receptacle of a vehicle, comprising;

a portable enclosure;

said portable enclosure comprising an interior space to be heated and cooled;

a Stirling cooler positioned about said enclosure and providing heating or cooling to said interior space; and an electrical line for powering said Stirling cooler via said electrical receptacle.

34. A heating and cooling device comprising:

an enclosure;

said enclosure comprising a hot compartment and a cold compartment;

a Stirling cooler;

said Stirling cooler comprising a hot end heat exchanger positioned in communication with said hot compartment and a cold end heat exchanger positioned in communication with said cold compartment;

said hot compartment comprising a fan therein positioned adjacent to said hot end heat exchanger;

said cold compartment comprising a condensate collector therein positioned adjacent to said cold end heat exchanger so as to collect condensate from said cold end heat exchanger; and a wick, said wick extending from said condensate collector in said cold compartment to said hot compartment so as to wick condensate from said condensate collector to said hot compartment and so as to evaporate said condensate via an air stream produced by said fan.

35. A transportable apparatus comprising:

an insulated enclosure for containing a plurality of containers, said enclosure being mountable in a vehicle;

a dispensing path defined by a pair of spaced members, said dispensing path being for receiving said plurality of containers in stacked relationship and for dispensing them sequentially from said apparatus; and a Stirling cooler, said Stirling cooler being powerable by said vehicle's electrical system.

36. The transportable apparatus of claim 35, wherein said enclosure comprises an inside, an outside and a outlet for dispensing said containers from said inside to said outside.

37. The transportable apparatus of claim 36, wherein said dispensing path comprises a first member positioned adjacent to said outlet, such that said containers in said dispensing path contact said first member before being dispensed through said outlet.

38. The transportable apparatus of claim 37, wherein said Stirling cooler comprises a hot portion and a cold portion and wherein said cold portion of said Stirling cooler is in heat transfer relationship with said first member.

39. The transportable apparatus of claim 38, further comprising a second member, one end of said second member being connected in heat transfer relationship to said first member and the other end of said second member being connected in heat transfer relationship to said cold portion of said Stirling cooler.

40. A method comprising powering a Stirling cooler by a vehicle's electrical system, positioning a container to be dispensed from an enclosure in heat transfer relationship with said Stirling cooler, and transferring heat between said Stirling cooler and said container.

41. The method of claim 40, wherein said enclosure comprises a heat-conducting member such that said method further comprises the step of positioning said heat conducting member in heat transfer relationship with said Stirling cooler.

42. The method of claim 41, wherein said Stirling cooler comprises a cold end such that said method further comprises the step of positioning said cold end of said Stirling cooler in heat transfer relationship with said heat conducting member.

43. The method of claim 41, wherein said Stirling cooler comprises a hot end such that said method further comprises the step of positioning said hot end of said Stirling cooler in heat transfer relationship with said heat conducting member.

44. A method comprising contacting at least a portion of a container to be dispensed from an insulated enclosure disposed in a vehicle with a heat-conducting member before said container is dispensed from said enclosure, such that heat is transferred from said container to said heat-conducting member, said heat-conducting member being connected in heat transfer relationship to a cold portion of a Stirling cooler, said Stirling cooler being powered by an electrical system of said vehicle.

45. A portable apparatus for containing a plurality of containers comprising:

an insulated enclosure;

said enclosure positioned within a vehicle;

said vehicle comprising an electrical system;

a Stirling cooler positioned in communication with said enclosure;

said Stirling cooler in communication with said electrical system; and said Stirling cooler comprising a cold end and a hot end in communication with said enclosure.

* * * * *

UNITED STATES PATENT AND TRADEMARK OFFICE

CERTIFICATE OF CORRECTION

PATENT NO. : 6,532,749 B2 
DATED : March 18, 2003
INVENTOR(S) : Arthur G. Rudick et al.

It is certified that error appears in the above-identified patent and that said Letters Patent is hereby corrected as shown below:

Title page,
Item [56], U.S. PATENT DOCUMENTS, please add the following:

| | | | |
|---|---|---|---|
| -- 3,935,899 | 2/1976 | Jolly | 165/29 |
| 5,111,644 | 5/1992 | Yang | 62/3.62 -- |

FOREIGN PATENT DOCUMENTS, please add the following:

| | | |
|---|---|---|
| -- EP | 0 935 063 | 8/1999 |
| FR | 2 767 912 | 3/1999 |
| JP | 01-082852 | 3/2001 |
| JP | 01-235266 | 8/2001 -- |

Delete "JP 2-217758 8/1990", and add -- JP 2-217758 8/1992 --.

Signed and Sealed this

Twelfth Day of August, 2003

JAMES E. ROGAN
*Director of the United States Patent and Trademark Office*